United States Patent [19]

Swain

[11] 4,193,748

[45] Mar. 18, 1980

[54] YOKE COUPLER FOR TWO ECCENTRICALLY ROTATING MEMBERS

[76] Inventor: James C. Swain, 3891 Mountview Rd., Columbus, Ohio 43220

[21] Appl. No.: 924,136

[22] Filed: Jul. 13, 1978

[51] Int. Cl.[2] ..... F01C 1/00; F01C 21/00; F03C 3/00; F16D 3/04

[52] U.S. Cl. ..... 418/173; 64/31

[58] Field of Search ..... 418/29, 172, 173, 174; 64/31

[56] References Cited

U.S. PATENT DOCUMENTS

| | | | |
|---|---|---|---|
| 1,359,792 | 11/1920 | Cracknell | 418/173 |
| 1,572,255 | 2/1926 | Uhl | 64/31 |
| 1,584,424 | 5/1926 | Bee | 64/31 |
| 1,945,220 | 1/1934 | Eyston | 418/173 |
| 2,513,446 | 7/1950 | Brown | 418/173 |

FOREIGN PATENT DOCUMENTS

| | | | |
|---|---|---|---|
| 631982 | 9/1927 | France | 418/173 |

*Primary Examiner*—John J. Vrablik

*Attorney, Agent, or Firm*—Richard W. Hanes

[57] ABSTRACT

A driving interconnection between two eccentrically rotating members for rotation at the same angular velocity about their respective axes without angular phase shift. The invention is adaptable to join an outer rotatable member to an inner one and is particularly useful for coupling the interior rotor and the external cam ring in certain types of positive fluid displacing devices. In one embodiment, the coupler comprises a central body with four outwardly extending arms. Two of the arms engage tightly fitting slots in the inner rotating member. The other two arms pass through clearance slots in the inner member and engage tightly fitting slots in the outer rotating member.

1 Claim, 6 Drawing Figures

YOKE COUPLER FOR TWO ECCENTRICALLY ROTATING MEMBERS

BACKGROUND OF THE INVENTION AND PRIOR ART

Some types of positive fluid displacing devices which are used as pumps or motors comprise an eccentrically mounted outer cam ring and an inner rotor interconnected by vanes which define a plurality of pumping chambers, hereinafter generally referred to as constrained vane devices. The rotor is driven within the rotating cam ring about an axis eccentric to the axis of the cam ring so that the volume of space enclosed by the rotor periphery, cam ring, side closure plates, and any two adjacent vanes varies from a maximum to a minimum during each revolution. Such devices traditionally have fixed or variable displacements, depending on the application. Displacement variation is obtained by changing the amount of offset between the axis of rotation of the rotor and axis of rotation of the cam ring. To accommodate the ever changing relationship between rotor and cam ring, the vanes are pivotally connected at one end to one of the rotating members and slidably received at the other end by the other member. Often, the slidable connection in one of the members is also pivotable. Examples of this general type of fluid displacing devices are disclosed in U.S. Pat. Nos. 1,210,042, 1,941,651, 2,714,372 and 3,426,693.

A primary design problem in these fluid displacing devices is coupling the cam ring and rotor together so that they maintain the same angular velocity over a total revolution and there is zero phase shift between them. Any cyclic difference in the angular velocity of the two rotating members will produce undesirable loads and wear on the coupler and other parts of the device, excessive vibration and fluid pressure pulsations in the system. Angular phase shift between the rotating members can also alter the intended timing of the moving parts so that the maximum capability of the device is not achieved.

One technique for rotating the cam ring and rotor together is to provide one member with pins which move in enlarged holes in the other. A second technique is to mesh the gears of the drive means for each rotating member. The first technique is used in U.S. Pat. Nos. 1,210,042, 1,941,652, 2,714,372 and 3,426,693. The aforesaid U.S. Pat. No. 1,941,652 to Behlmer also illustrates the second technique in FIGS. 6 and 7. Neither technique provides an acceptable solution to the coupling problem of a variable displacement device and they provide only a marginally acceptable solution for a fixed displacement device.

The disclosure contained in my co-pending U.S. patent application, Ser. No. 756,064, now U.S. Pat. No. 4,125,031, teaches a distinct and separate method for interconnecting two eccentrically mounted rotating members, utilizing a crank shaft.

The preferred embodiment of the instant invention is kinematically equivalent to the intermediate cross member in an Oldham type shaft coupling, the novelty here being in the adaptation of the basic principles of the Oldham coupling to the basic elements of a positive fluid displacing device in such a manner as to maintain the integrity of the sealing boundries of such devices.

OBJECTS OF THE INVENTION

The primary object of the present invention is to provide a coupler for operatively joining two eccentrically disposed members for rotation at the same angular velocity about their respective axes. The coupler is adaptable for use in synchronizing the rotation of a cam ring and rotor in a positive fluid displacing device.

Another object of the invention is to provide a coupling for a driving interconnection between a rotating inner member and an eccentrically mounted outer ring as are found on fluid displacing devices such as pumps, motors or heat engines, and where the coupling will preserve the integrity of the fluid sealing characteristics of the device.

A further object is to provide a constant velocity coupling that is easy to assemble, economical to produce, and not unduly effected by manufacturing tolerances.

Other and still further objects, features and advantages of the invention will be apparent from a reading of the following detailed description of a preferred embodiment taken in connection with the accompanying drawings in which.

DETAILED DESCRIPTION OF THE INVENTION

Figure 2:
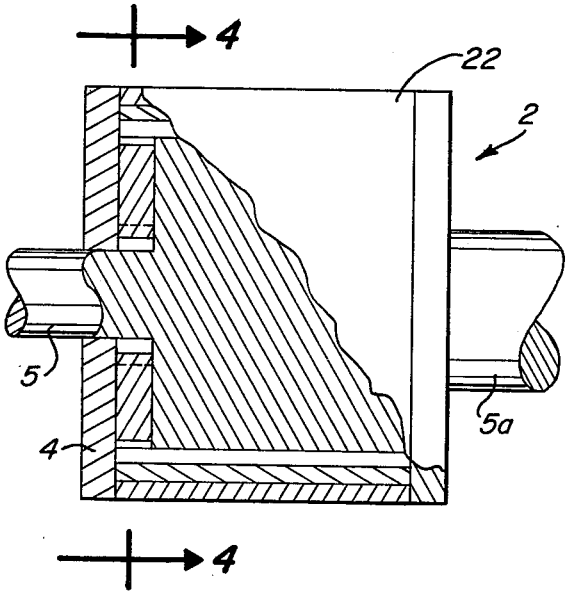
FIG. 2 is a side view of the fluid displacement device.
Figure 1:
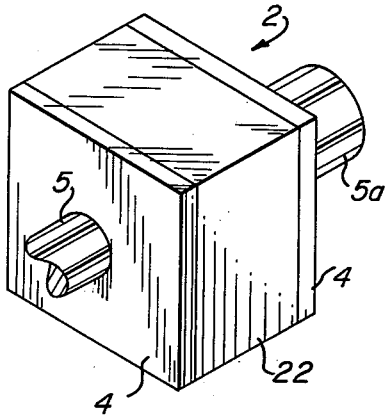
FIG. 1 is a perspective view of the fluid displacement device containing the coupler of the present invention.
Figure 3:
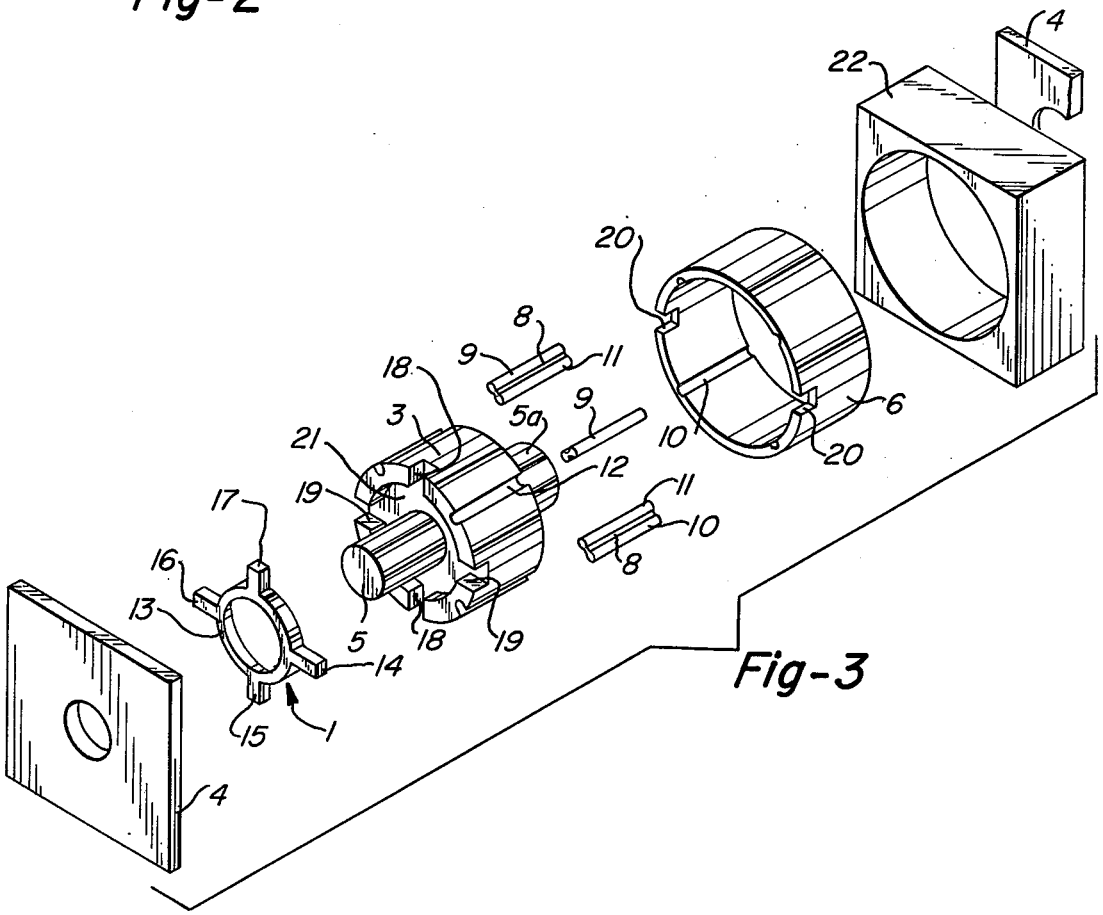
FIG. 3 is an exploded perspective view of the fluid displacement device.
Figure 4A:
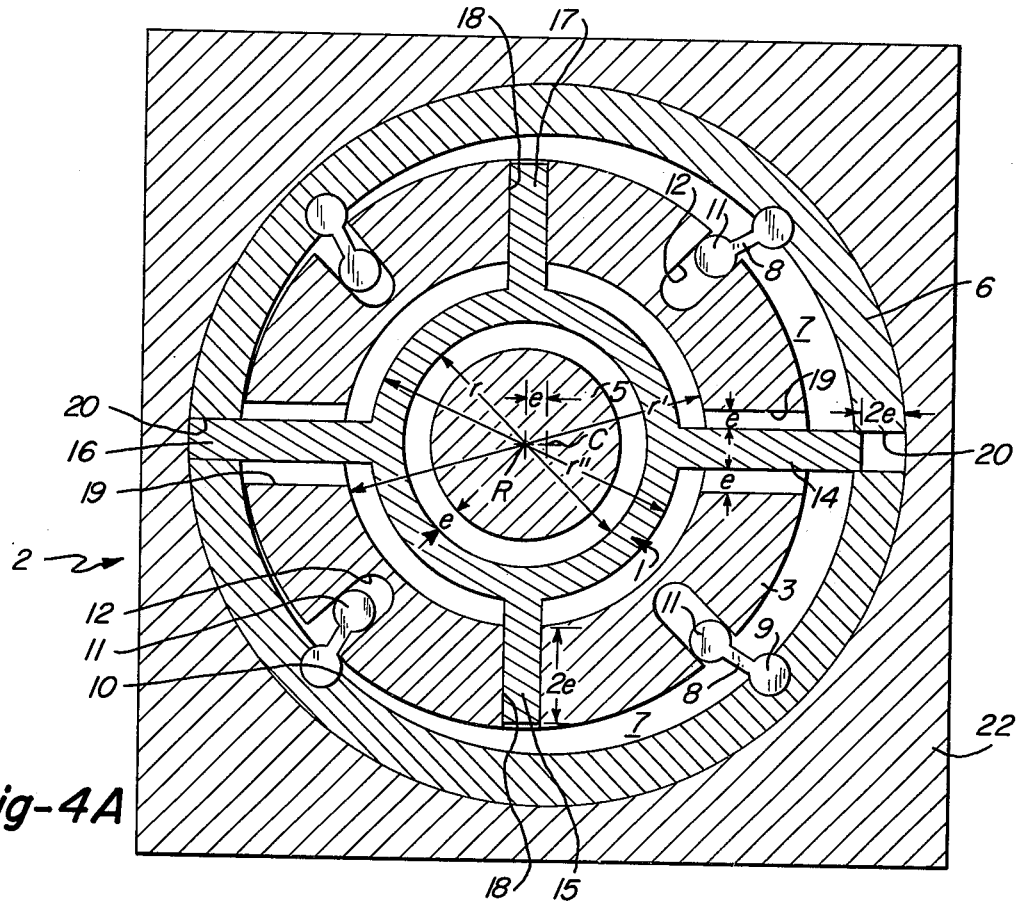
FIG. 4A is a cross-sectional view taken along lines 4—4 of FIG. 2 during one portion of a cycle.
Figure 4B:
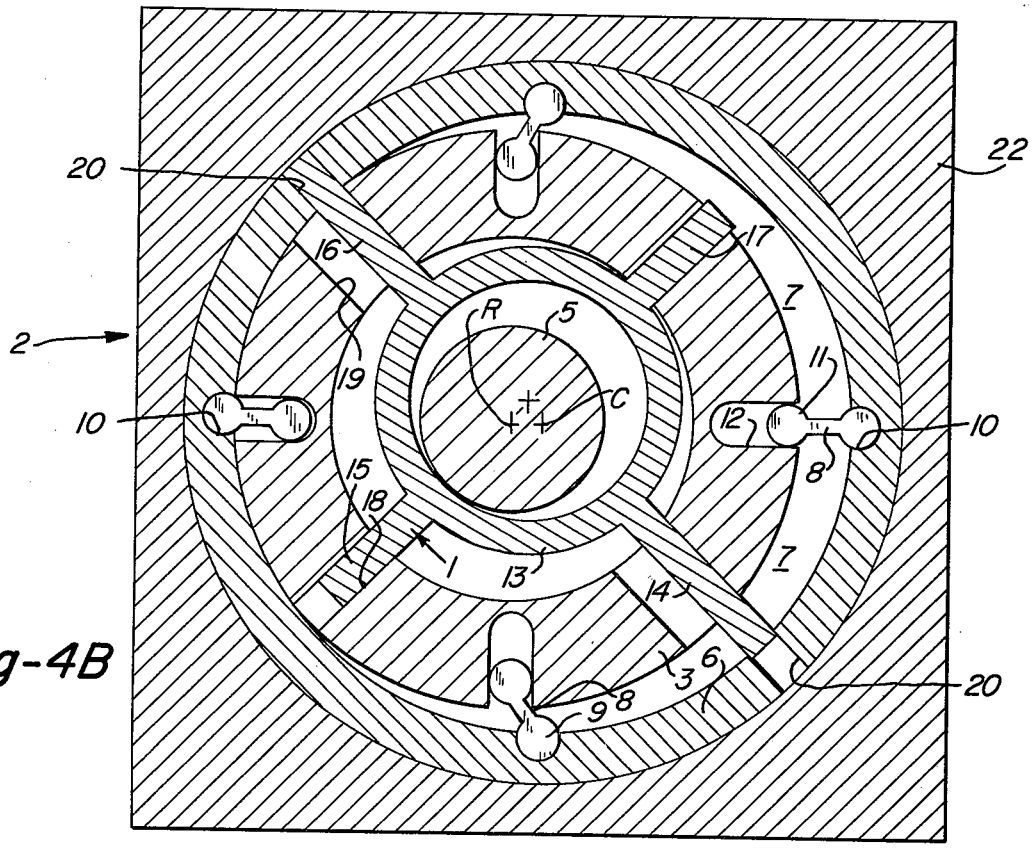
FIG. 4B is a cross-sectional view taken along lines 4—4 of FIG. 2 during a portion of a cycle 45° from that of FIG. 4A.
Figure 4C:
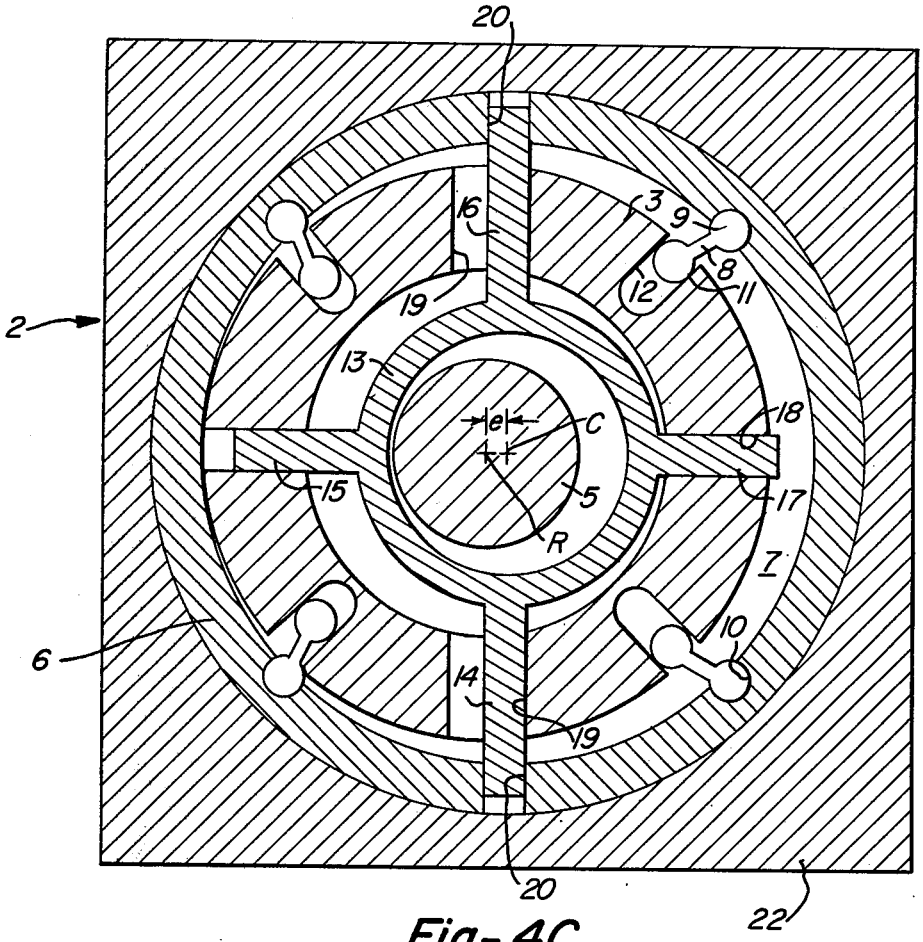
FIG. 4C is a cross-sectional view taken along lines 4—4 of FIG. 2 during a portion of a cycle 90° from that of FIG. 4A.

The preferred form of yoke coupler of the present invention is shown in use with a constrained vane pump 2. The pump includes a rotor 3 housed in block 1 and journaled for rotation in the sides 4 of the pump about an axis R defined by the drive shaft 5. A cylindrical cam ring 6 surrounds the rotor 3 and is rotated about an axis C. The coupler 1 joins the rotor 3 and cam ring 6 so that when one is rotated, the other will follow without angular phase shift therebetween. Pumping vanes 8 span the space between the cam ring 6 and the rotor 3. The vanes 8, rotor 3, cam ring 6, and sides 4 define a plurality of pumping chambers 7. The outer cylindrical end 9 of each vane 8 is pivotally mounted in a socket 10 in the cam ring 6. The inner end 11 is slidably received in a groove 12 in the rotor 3. As the rotor 3 and the cam ring 6 rotate eccentrically, the volume enclosed by each of the pumping chambers 7 varies from a maximum to a minimum during each revolution.

The coupler 1 comprises an annular central portion 13 and four outwardly extending arms 14–17. Arms 15 and 17 are slidably received in a tight fitting relationship in the rotor 3 in aligned or opposed parallel slots 18. Arms 14 and 16 pass through enlarged slots 19 in the rotor 3 and extend outwardly where they are received in a tight, sliding relationship in opposed parallel or aligned slots 20 in the cam ring 6. The arms 14–17 of the coupler 1 are stiff and insure that when the rotor 3 is rotated, the cam ring 6 will follow without any relative angular movement.

The fluid displacement capability of the pump can be changed by varying the amount of offset between the axes of rotation R and C of the rotor 3 and cam ring 6.

The stroke of the pump is twice the eccentric distance e between the axes R and C. Consequently, to accommodate the movement of the coupler relative to the rotor 3, the inner diameter of the central portion 13 of the coupler must be greater than the outside diameter of the drive shaft 5 by at least 2e. In like manner, the inner diameter r' of the rotor 3 surrounding the central ring portion 13 of the coupler must be larger than the outer diameter r'' of the central portion 13 by at least 2e. The slots 18 in the rotor 3 which receive the coupler arms 15 and 17 must have a radial depth equal to the distance 2e plus a minimum engagement length. The width of the slots in the rotor through which the coupler arms 14 and 16 pass is at least 2e plus the width of each arm. Finally, the slots 20 in the cam ring 6 which receive the arms 16 and 17 extend a radial distance 2e plus a minimum engagement length.

The coupler 1 can be positioned at one or both axial ends of the rotor 3 so as not to disturb the sealing capability of the pump. The integrity of the seal is maintained by the tight fit of the central portion of the coupler 13 between the inside surface of the side wall 4 and the rotor end surface 21, the tight fit between the coupler arms 15, 17 and the rotor slots 18 and the fit between the longer coupler arms 14, 16 and the cam ring slots 20.

In the preferred embodiment, the shaft is integral with the rotor. Because of the clearance which is necessary between the drive shaft and the central ring portion 13 of the coupler 1, the end 5 of the shaft which accommodates the coupler is of reduced diameter while the other end 5*a* of the shaft is sized for delivering power into or out of the device.

The yoke coupler of this invention is adaptable for use in joining any two eccentrically rotating members. Its application has been illustrated with a constrained vane device which is applicable to pumps, motors, heat engines and elements thereof handling gases or liquids or mixtures of the two.

I claim:

1. A fluid displacement device comprising:

a rotor having a drive shaft;

a cylindrical cam ring surrounding the rotor and eccentrically mounted with respect thereto;

a housing member rotatably carrying the cam ring;

a pair of side plates sealingly attached to the housing and having journal means therein for rotatably carrying the drive shaft;

a plurality of pumping vanes pivotally attached to the cam ring and having a sliding and pivotal interconnection to the rotor, forming a plurality of pumping chambers therebetween;

a coupling member interconnecting the rotor and the cam ring comprising:

a central hub circumscribing the drive shaft and carrying four outwardly projecting four-sided coplaner arms, and disposed in fluid sealing engagement between the out-facing side of said arms and hub and the in-facing side of one of said plates;

a pair of opposed slots disposed in the lateral side of the cam ring, each being respectively adapted to slidingly receive and in fluid sealing engagement with one of two opposed arms carried by said central hub.

a pair of opposed slots disposed in the lateral side of the rotor, each being respectively adapted to slidingly receive, and in fluid sealing engagement with, one of two opposed arms carried by said central hub.

* * * * *